US010026542B2

(12) United States Patent
Walberg et al.

(10) Patent No.: US 10,026,542 B2
(45) Date of Patent: Jul. 17, 2018

(54) SHIELDING FOR AN INDUCTIVE DEVICE WITH CENTRAL FIRST WINDING CONNECTION

(71) Applicant: ABB Schweiz AG, Baden (CH)

(72) Inventors: Kjell Walberg, Ludvika (SE); Roger Eklund, Ludvika (SE)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 15/537,218

(22) PCT Filed: Dec. 16, 2015

(86) PCT No.: PCT/EP2015/079953
§ 371 (c)(1),
(2) Date: Jun. 16, 2017

(87) PCT Pub. No.: WO2016/096960
PCT Pub. Date: Jun. 23, 2016

(65) Prior Publication Data

US 2017/0352472 A1 Dec. 7, 2017

(30) Foreign Application Priority Data

Dec. 17, 2014 (EP) ..... 14198578

(51) Int. Cl.
*H01F 27/32* (2006.01)
*H01F 27/28* (2006.01)
*H01F 27/36* (2006.01)

(52) U.S. Cl.
CPC ..... *H01F 27/2885* (2013.01); *H01F 27/32* (2013.01); *H01F 27/36* (2013.01); *H01F 27/362* (2013.01)

(58) Field of Classification Search
CPC ..... H01F 27/00–27/36
(Continued)

(56) References Cited

U.S. PATENT DOCUMENTS 3,376,523 A * 4/1968 Kerns ..... H01F 27/33 333/177
6,377,153 B1 * 4/2002 Yamanaka ..... H01F 27/362 336/182

(Continued)

FOREIGN PATENT DOCUMENTS

EP 3035348 A1 6/2016
JP S6081809 A 5/1985

(Continued)

OTHER PUBLICATIONS

European Search Report Application No. 14198578.8 Completed Date: May 18, 2015; dated Jun. 8, 2015 5 Pages.

(Continued)

*Primary Examiner* — Tuyen Nguyen
(74) *Attorney, Agent, or Firm* — Whitmyer IP Group LLC

(57) ABSTRACT

An inductive device including a first and second concentric winding wound around a center axis of the inductive device, where the second winding is placed outside of the first winding and provided in two separate parts a first upper part and a second lower part, wherein there is an opening between the first and second parts of the second winding and the first winding has a first winding connection that passes through said opening, the inductive device further including a concentric electric shielding element around the center axis and stretching all the way between the upper and the lower part of the second winding, the shielding element including a metal shield layer.

18 Claims, 2 Drawing Sheets

(58) Field of Classification Search
USPC ..... 336/65, 84 C, 84 R, 206, 182–184
See application file for complete search history.

(56) References Cited

U.S. PATENT DOCUMENTS

| | | | | |
|---|---|---|---|---|
| 6,888,436 | B1 * | 5/2005 | Yagasaki | H01F 27/2885 336/69 |
| 7,692,524 | B2 * | 4/2010 | Miller | H01F 27/263 336/84 C |
| 7,868,724 | B2 * | 1/2011 | Sicong | H01F 27/362 336/84 R |
| 8,085,121 | B2 * | 12/2011 | Hanov | H01F 27/362 336/84 C |
| 2008/0211611 | A1 | 9/2008 | Hanov | |

FOREIGN PATENT DOCUMENTS

| | | | |
|---|---|---|---|
| JP | S60193314 | A | 10/1985 |
| JP | S62126609 | A | 6/1987 |
| JP | S62126611 | A | 6/1987 |

OTHER PUBLICATIONS

International Search Report and Written Opinion Application No. PCT/EP2015/079953 Completed Date: Feb. 9, 2016; dated Feb. 22, 2016 10 Pages.

* cited by examiner

SHIELDING FOR AN INDUCTIVE DEVICE WITH CENTRAL FIRST WINDING CONNECTION

TECHNICAL FIELD

The present invention generally relates to high voltage applications devices. More particularly the present invention relates to an inductive device comprising first and second windings.

BACKGROUND

Voltages used in power transmission systems are getting higher and higher. Voltage levels in the range of 600-1200 kV are known to be used.

At these levels the size of the equipment used is large, which is especially the case with inductive devices such as transformers. A transformer that is to operate at the above-mentioned voltage levels may be so large and bulky that it is hard to transport. The different components, such as the windings may then also become heavy.

There is therefore a need for limiting the size. At the same time it is important that the insulation is able to provide sufficient insulation. Insulation is usually provided through the use of cellulose and transformer oil.

Although the above mentioned issues are important at high voltage levels, it should be realized that they may also be of interest at lower voltage levels.

One way to reduce the size of inductive devices is disclosed in JPS 62-126609. JPS 62-126609 discloses a foil wound transformer, where low voltage windings are provided around high voltage windings. Furthermore high voltage lead wires lead out from the inner high voltage windings in the center between the outer windings.

In a transformer of the above-described type it is also necessary to provide a shielding of the winding through which the lead wires lead. The traditional way of providing such shielding is through providing the shielding as two separate thin shielding rings at the top and bottom of the winding. However, then the electrical field will be non-uniform and high at the shielding rings.

It is also necessary to provide insulation between the central wires and the windings through which they pass. This insulation may be hard to design.

One problem that faces the design of the insulation is that the above-mentioned shielding system cause high dielectric creep stresses in the insulation.

Another problem that may face the design of the insulation is how to design it so that it is also able to receive the assembly forces as well as the short circuit forces on the outer winding.

There is in this respect a need for an improved shielding that solves at least some of the problems mentioned above.

SUMMARY

One object of the present invention is to provide a compact inductive device with improved shielding.

This object is according to the present invention obtained through an inductive device comprising:

a first and second concentric winding wound around a center axis of the inductive device, where the second winding is placed outside of the first winding and provided in two separate parts a first upper part and a second lower part, wherein there is an opening between the first and second parts of the second winding and the first winding has a first winding connection that passes through said opening, the inductive device further comprising a concentric electric shielding element around the center axis and stretching all the way between the upper and the lower part of the second winding, the shielding element comprising a metal shield layer.

The present invention has a number of advantages. It provides a compact and less bulky inductive device. Furthermore, as the shielding element stretches all the way from the first part of the second winding to the second part of the second winding, there are no edges in the insulation close to any part of the second winding. Thereby the problem of high dielectric creep stresses in the insulation is avoided.

BRIEF DESCRIPTION OF THE DRAWINGS

The present invention will in the following be described with reference being made to the accompanying drawings, where FIG. 1 schematically shows a transformer, FIG. 2 schematically shows a cross-section through the transformer in FIG. 1, FIG. 3 schematically shows a cross-section through a shielding element used in the transformer.

DETAILED DESCRIPTION

The present invention concerns an inductive device, for instance a transformer, which may be used in high voltage applications, such as in a High Voltage Converter Transformer. The inductive device may as an example be used in Ultra High Voltage AC (UHVAC) and Ultra High Voltage DC (UHVDC) applications, where the AC voltage is in the area of 750 kV-1000 kV and the DC voltage may be in the rage 600-800 kV.

However, it has to be stressed that this is merely one field in which the present invention may be used.

An inductive device, such as a transformer, may then be equipped with a first winding concentrically surrounded by a second winding.

The power transfer capability of such an inductive device may need to be high, which in turn requires large insulation distances and therefore large windings.

Inductive devices like transformers may because of this become bulky, where one factor influencing the bulkiness is thus the required insulation distance. It is however possible to reduce the size. One way to reduce the size is through having the connection to the first winding physically drawn through the center of the second winding of the inductive device.

One way of reducing the size is thus through providing a first winding conductor for connection to the first winding through the middle of the second winding.

Figure 1:
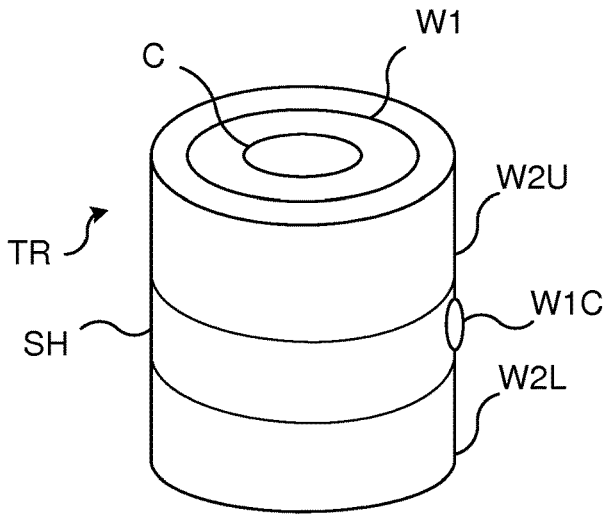
Figure 2:
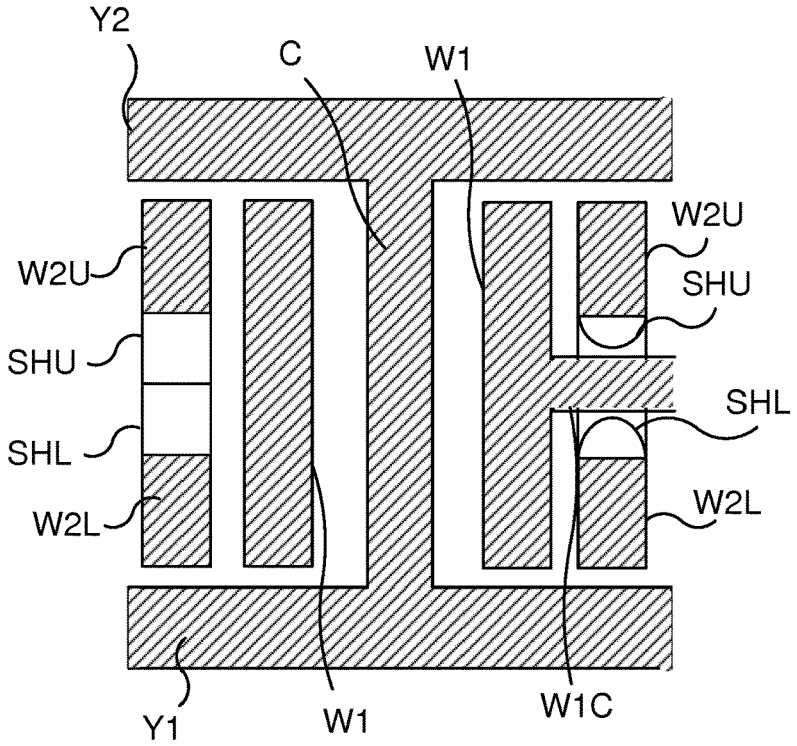

FIG. 1 shows a perspective view of a schematic transformer having this type of realization. FIG. 2 shows a schematic sectional view of the transformer in FIG. 1.

As can be seen in FIGS. 1 and 2, the transformer TR has a cylindrical shape and comprises a number of physical windings wound around a core C. There is here a first inner winding W1 and outside of this first winding W1 there is a second outer winding, which second winding is provided in two separate parts; a first upper part W2U and a second lower part W2L. The core C thereby forms or defines a center axis around which the first winding W1 and the second winding are wound, where the second winding is wound outside of the first winding W1. The windings may be inductively coupled to each other. The windings are thus provided concentrically around the transformer core C. The lower end of the core is connected to a first yoke Y1 and the upper end is connected to a second yoke Y2.

The first upper part W2U and the second lower part W2L are furthermore separated by a concentric static shielding element SH that stretches all the way from the upper to the lower part W2U and W2L of the second winding. The shielding is furthermore galvanically connected to second winding. Thereby the static shielding element is also provided concentrically around the center axis.

Furthermore, as can be seen in FIGS. 1 and 2, the first winding connection W1C, i.e. an electrical connection to the first winding W1, is provided at the middle of this first winding W1. The first winding connection W1C also stretches or passes through an opening between the upper and lower parts W2U and W2L of the second winding. The shielding element SH further surrounds the opening. In the area surrounding the opening the shielding SH is provided with an opening interfacing section. The opening interfacing section may have a shape resembling half a toroid that completely encircles the hole. This means that the opening interfacing section may have a cross-sectional area that resembles half a circle.

Furthermore, the shielding element may be provided in two halves or parts. There may be an upper part SHU stretching from the upper part W2U of the second winding and a lower part SHL stretching from the lower part W2L of the second winding. The first and second parts of the shielding element may then in the direction of the center axis meet each other at the opening.

Through the provision of the shielding element in two parts, the assembly of the transformer is simplified.

Although not shown in FIGS. 1 and 2, there may be insulation between the first winding W1, the second winding and the first winding connection W1C. Such insulation may then typically also be provided in the opening between the shielding element SH and the first winding connection W1C. There may also be insulation between the core C and the first winding W1. There may furthermore be insulation provided on the outside of the second winding, i.e. on the side facing away from the center axis, as well as around the first winding connection W1C leaving the transformer TR.

The above shown realization of the first winding connection W1C that leaves the transformer TR through the opening between the upper and lower parts W2U and W2L of the second winding has the advantage of providing a more compact transformer. Thereby the transformer TR is easier to transport and also easier to handle. It also provides a transformer that is economical, has low losses and high reliability. Furthermore a voltage outtake from the first winding W1 in the axial direction, i.e. via the first or the second yoke Y1 and Y2, has a substantially lower potential than the potential of the first winding connection W1C due to the non-uniform insulation system.

However, unless special attention is given to the realization of the shielding a number of problems associated with the insulation provided around the second winding may occur.

One of the problems that would normally occur is the problem of dielectric high creep stresses caused by the non-uniform electrical field.

Due to the fact that the shielding element SH stretches all the way between the upper and lower parts W2U and W2L of the second winding, the shielding has no edges at either of the upper and lower parts of the second winding. This is thus beneficial from a dielectric point of view because the electrical field is uniform and high dielectrical stresses can be avoided.

Another problem associated with the insulation is that the windings will be exposed to assembly force and short circuit forces. These forces may complicate the design of the insulation between the upper and lower parts W2U and W2L of the second winding.

A variation of the invention is concerned with this further problem. According to this variation, the shielding element SH rests on the lower part W2L of the second winding, with the upper part W2U of the second winding resting on the shielding element. Thereby the shielding element SH receives all the assembly and short circuit forces. Because the shielding element SH receives all the forces, the insulation provided in the opening for insulating between the secondary winding and first winding conductor W1C, does not receive this force. Therefore, this insulation only has to be dimensioned for providing good insulating properties. There is no need to consider the forces from assembly and short circuit, which simplifies the construction of the insulation.

Figure 3:
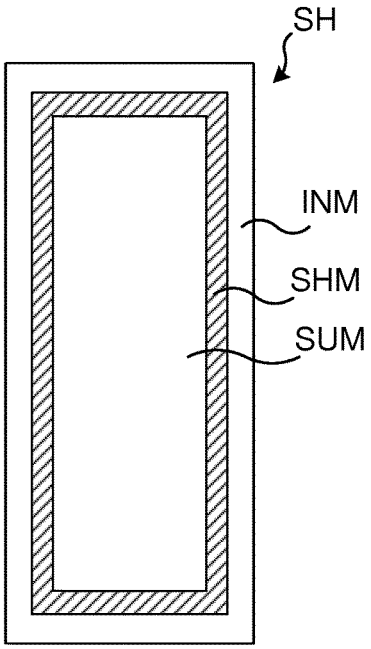

FIG. 3 schematically shows a cross-section through the shielding element SH that is suitable for receiving the force of the upper part of the second winding, which cross-section is taken at an area separate from the area surrounding the hole.

The shielding element comprises a layer of supporting material SUM designed to receive and withstand the forces of the second winding, a layer of insulating material INM surrounding the layer of supporting material SUM and a layer of shielding material SHM in-between the layer of supporting material SUM and the layer of insulating material INM. The layer of supporting material SUM or supporting layer is thereby thicker than the layer of shielding material SHM or shielding layer and with advantage thicker than the shielding layer and layer of insulating material INM or insulation layer together.

The supporting layer may be made of a material that is able to withstand the forces. It may therefore with advantage be a filament wound glassfibre.

The shield layer is in turn designed for having a good shielding ability. It may for this reason be of an electrically conducting material, such as a metal with good electrical conduction ability. It may for instance be a foil or film of aluminium, which is additionally lightweight. It can thereby also be seen that the shield has to be an electric shield.

The insulation layer may be a conventional insulation layer such as a layer of cellulose.

This type of structure has a good ability to withstand the mechanical forces.

Above it was mentioned that the opening interfacing section is shaped as half a toriod with a circular cross-section. This may be varied somewhat.

Figure 4:
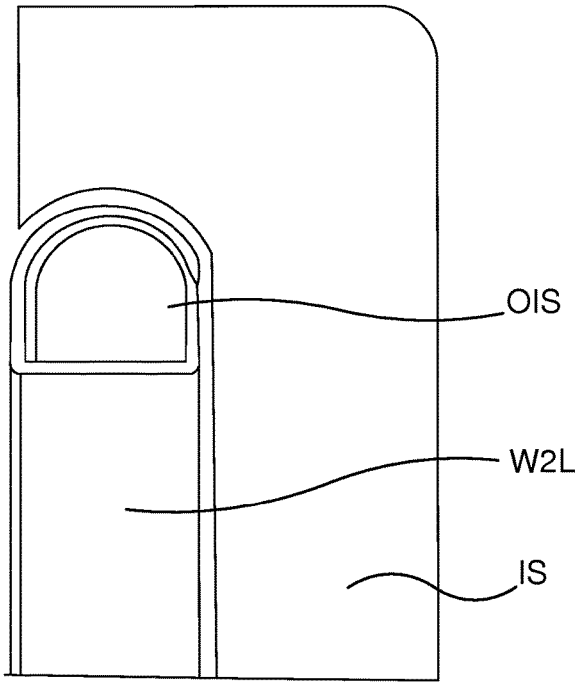
FIG. 4 shows a cross section view of parts of insulation, the shielding element and a winding at a part of an opening in the shielding element, where the part of the shielding element that surrounds the opening is an opening interfacing section.
Figure 5:
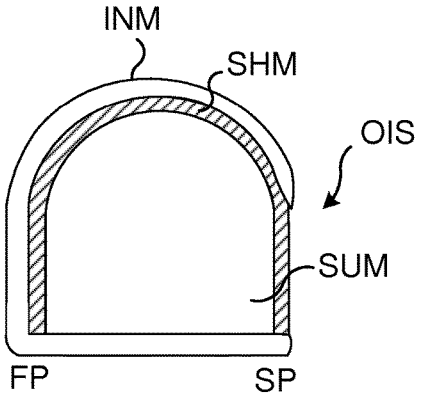
FIG. 5 shows a detailed cross-section of the opening interfacing section of the shielding element.

FIG. 4 shows a cross section view of parts of insulation IS, a part of the opening interfacing section OIS of the lower part of the shielding element SHL as well as a section of the lower part W2L of the second winding in the area of the opening. The cross-section of the opening interfacing section OIS is shown in greater detail in FIG. 5.

It can be seen that the opening interfacing section OIS is not quite circular, but has a curvature that deviates from the circular. The curvature furthermore stretches one hundred and eighty degrees from a first point FP facing the first winding W1 at right angles to the center axis to a second point SP facing away from the first winding W1 at right angles to the center axis.

Furthermore, the radius R of the curvature of the cross-section varies. The radius R is higher in the direction radially inwards, i.e. towards the first winding W1, than radially outwards from the transformer.

The insulation layer INM of the opening interfacing section OIS furthermore stretches approximately one hundred and twenty degrees from the first point towards the second point SP.

This realization of the opening interfacing section OIS has the advantage of providing further improvements in relation to the insulation and especially in the reduction of dielectric stresses.

One obvious area where the invention is of advantage is in relation to power transmission at high voltages, because in this area size limitations are of interest. However, size limitations may be of interest also in other voltage ranges. Consequently it has to be realized that the invention is in no way limited to high voltage applications. Furthermore, even though the invention has been described in relation to a transformer, it should be known that it may be implemented in any inductive device comprising at least two concentric windings.

From the foregoing discussion it is evident that the present invention can be varied in a multitude of ways. It shall consequently be realized that the present invention is only to be limited by the following claims.

The invention claimed is:

1. An inductive device comprising:

a core forming a center axis of the inductive device, a first concentric winding and a second concentric winding wound around the center axis of the inductive device, where the second winding is placed outside of the first winding and provided in two separate parts, the two separate parts including a first upper part and a second lower part, wherein there is an opening between the first upper part and the second lower part of the second winding, and the first winding has a first winding connection that passes through said opening, the inductive device further comprising a concentric electric shielding element around the center axis, the shielding element stretching all the way between the first upper part and the second lower part of the second winding, the shielding element comprising a metal shield layer.

2. The inductive device according to claim 1, said shielding element resting on the second lower part of the second winding, with the first upper part of the second winding resting on the shielding element such that the shielding element receives a gravitational force of the first upper part of the second winding, the shielding element further surrounding the opening.

3. The inductive device according to claim 1, wherein the shielding element comprises an upper part stretching from the first upper part of the second winding and a lower part stretching from the second lower part of the second winding, the first and second parts of the shielding element meeting each other in a direction of the center axis at the opening.

4. An inductive device comprising:

a first concentric winding and a second concentric winding wound around a center axis of the inductive device, where the second winding is placed outside of the first winding and provided in two separate parts, the two separate parts including a first upper part and a second lower part, an opening between the first upper part and the second lower part of the second winding, and the first winding has a first winding connection that passes through said opening, and a concentric electric shielding element around the center axis, the shielding element stretching all the way between the first upper part and the second lower part of the second winding, the shielding element comprising a metal shield layer, wherein the shielding element comprises a supporting layer designed to receive and withstand a gravitational force of the first upper part of the second winding and an insulation layer surrounding the supporting layer, wherein the shield layer is provided in-between the supporting layer and the insulation layer.

5. The inductive device according to claim 4, wherein the supporting layer is a filament wound glassfibre.

6. The inductive device according to claim 4, wherein the shielding layer is a metal foil.

7. An inductive device comprising:

a first concentric winding and a second concentric winding wound around a center axis of the inductive device, where the second winding is placed outside of the first winding and is provided in two separate parts, the two separate parts including a first upper part and a second lower part, an opening between the first upper part and the second lower part of the second winding, and the first winding has a first winding connection that passes through said opening, and a concentric electric shielding element around the center axis, the shielding element stretching all the way between the first upper part and the second lower part of the second winding, the shielding element comprising a metal shield layer, wherein the shielding element has an opening interfacing section surrounding the opening, said opening interfacing section being curved, the curvature stretching one hundred and eighty degrees from a first point facing the first winding at right angles to the center axis to a second point facing away from the first winding at right angles to the center axis.

8. The inductive device according to claim 7, wherein the curvature has a radius that is higher in the direction towards than away from the first winding.

9. The inductive device according to claim 8, wherein an insulation layer of the opening interfacing section stretches one hundred and twenty degrees from the first point towards the second point.

10. The inductive device according to claim 1, further comprising insulation in the opening between the shielding element and the first winding connection.

11. The inductive device, according to claim 10, further comprising insulation between the first winding, the second winding and the first winding connection.

12. The inductive device according to claim 1, wherein it is designed for operation in a range of 600-1200 kV.

13. The inductive device according to claim 1, wherein it is a transformer.

14. The inductive device according to claim 1, wherein it is a reactor.

15. The inductive device according to claim 2, wherein the shielding element comprises an upper part stretching from the first upper part of the second winding and a lower part stretching from the second lower part of the second winding, the first and second parts of the shielding element meeting each other in a direction of the center axis at the opening.

16. The inductive device according to claim 5, wherein the shielding layer is a metal foil.

17. The inductive device according to claim 6, wherein the metal foil comprises an aluminum foil.

18. The inductive device according to claim 16, wherein the metal foil comprises an aluminum foil.

* * * * *